United States Patent [19]

Starkweather

[11] Patent Number: 4,733,982

[45] Date of Patent: Mar. 29, 1988

[54] ADAPTIVE PAPER SLOT DEVICE FOR AN ACOUSTIC SILENCER ENCLOSURE

[76] Inventor: Bret Starkweather, 15416 Bryant Ave. South, Burnsville, Minn. 55337

[21] Appl. No.: 13,632

[22] Filed: Feb. 11, 1987

[51] Int. Cl.[4] ..... B41J 29/08

[52] U.S. Cl. ..... 400/690

[58] Field of Search ..... 400/689–691, 400/693; 181/200, 201, 284, 287, 199, 204

[56] References Cited

U.S. PATENT DOCUMENTS

| | | | |
|---|---|---|---|
| 1,604,541 | 10/1926 | Waldheim | 400/690 |
| 1,647,674 | 11/1927 | Tyberg | 400/690 |
| 1,654,922 | 1/1928 | Daniel | 400/690 |
| 1,655,194 | 1/1928 | Newsom | 181/287 |
| 1,910,981 | 5/1933 | Bescherer | 181/201 |
| 2,164,227 | 6/1939 | Britten, Jr. | 197/133 |
| 3,122,228 | 2/1964 | Dollenmayer et al. | 197/207 |
| 3,506,087 | 4/1970 | Ishikawa | 181/199 |
| 3,747,735 | 7/1973 | Frick | 181/201 |
| 3,762,489 | 10/1973 | Proksch | 181/204 |
| 4,550,798 | 11/1985 | Swartz et al. | 181/201 |

FOREIGN PATENT DOCUMENTS

| | | | |
|---|---|---|---|
| 23047 | 8/1904 | United Kingdom | 354/195 |

*Primary Examiner*—Edgar S. Burr
*Assistant Examiner*—James A. Lisehora
*Attorney, Agent, or Firm*—Donald A. Jacobson

[57] ABSTRACT

An adaptive paper slot device providing adjustment for the location of paper slot feeds to and from a printer located within an acoustic silencer enclosure to permit using one enclosure with a number of printers having different paper feed locations. The adapter device is mounted on one wall of the silencer enclosure and has a number of adjustable horizontal bars which cover the end of the enclosure with horizontal slots between the bars. The bars can be relocated to move the slots for paper feed to any desired vertical location. The inner surface of the bars is covered with sound absorbing material to maintain the integrity of the acoustic silencer enclosure excepting for the proper feed slots themselves.

2 Claims, 5 Drawing Figures

ADAPTIVE PAPER SLOT DEVICE FOR AN ACOUSTIC SILENCER ENCLOSURE

BACKGROUND OF THE INVENTION

I. Field of the Invention

This invention relates generally to an acoustic silencer for printers used primarily as computer output devices and in particular to an acoustic silencer with a device having slots for paper ingress and egress which can readily be repositioned for different paper feed locations on a variety of printers.

II. Description of the Prior Art

There are a number of silencers for printers and typewriters. In U.S. Pat. Nos. Waldheim 1,604,541; Dollenmayer et al 3,122,228; Britten 2,164,227; Tyberg 1,647,674; Daniel 1,654,922; and Swartz 4,550,798; a number of silencer devices are taught. Waldheim uses a sound deadening casing made up of a boxlike member which encloses a typewriter framework with a cover or hood to seal the sounds from the operation of the typewriter. The hood is open at the front to provide a sufficient aperture so the machine carriage control levers can be manipulated. Dollenmayer et al uses a sliding door mounted within an enclosure such that the enclosure can be slid over the printing portion of the typewriter to reduce the noise level. Daniel uses a plate mounted on a typewriter over the typewriter keys proper. A second plate is attached to the typewriter movable carriage such that the first plate is overlapped. These two plates cooperate to cover the keys and reduce the noise level. Tyberg uses a casing which will fit over the print and carriage portion of a typewriter and provides a narrow aperture for the printed portion of the paper. A glass plate is provided in front of the casing to permit observation of the characters being typed. Britten uses a casing arranged to be mounted over a paper tape feed to confine the noise to the mechanism. Paper tape is fed from a platen through an exit slot in the casing to reduce the vibration due to the type bars striking the paper. Swartz et al uses an acoustic enclosure which has interconnected sound reducing panels forming a substantially rectangular structure which is configured to house a computer printer. Each side panel as well as the top and bottom have acoustic absorbing material in its construction. A rigid thermoplastic hinged cover is provided for closing the enclosure.

None of these devices addresses the problem of adapting a single acoustical enclosure for use with a variety of different printers which have different vertical locations for the horizontal paper feed slots. An incorrectly located paper feed results in paper jamming and filling the acoustic silencer enclosure.

SUMMARY OF THE PRESENT INVENTION

Modern printing equipment used as an output device for computers incorporates a tractor feed mechanism, which cooperates with opposing sets of holes in the paper, to permit the paper to be fed automatically by the printer. Typically, a stack of new paper stock is fed from a container into the printer and then from the printer to be collected in a suitable container. Printing equipment for this use is high speed, because of the computer output capability, and as a consequence is quite noisy.

Previous devices have recognized the problem of the noise generated by a printer and have approached this problem by a variety of sound insulated enclosures designed for a single machine. None of these previous devices have recognized the problem presented by the great variety of printers currently in use with the corresponding variety of paper feed locations. A considerable number of printers used in this application are similar in size but, because of their different paper input and output feed locations, each require a different acoustical silencer box. This results in a large number of acoustic silencer designs merely to accomodate the different paper feed locations.

The instant device uses a frame having an opening with two vertical outboard slotted edges with vertical slits. A set of horizontal bars are mounted across and attached through these slits such that the bars can be adjusted vertically within the slits to provide horizontal openings for paper feed. By changing the position of these bars with respect to each other, the location of the horizontal openings can be changed to any desired vertical point within the frame restricted only at the extremities by the modular size of the bars themselves.

This frame is mounted such that it provides one side wall of an acoustic silencer box. The remaining walls of the box are conventional and are lined with any desired sound absorbing material. The horizontal bars across the frame opening are U-shaped and arranged such that the U-shaped projections are directed into the box between the slitted edges. These projections are filled with a sound absorbing material. This arrangement provides a mechanism for readily positioning the paper slot locations any desired place within the frame opening while still providing the maximum amount of sound absorbing material exposed to the sound energy.

This adjusting mechanism permits one size acoustic silencer box to be used with a large number of tractor feed printers with essentially no reduction in silencer capability but with a great reduction in the number of acoustic silencer boxes required. The mechanism is simple to manufacture and adjust, and the frame and bars can be made of metal or plastic as desired.

DESCRIPTION OF THE PREFERRED EMBODIMENT

Figure 1:
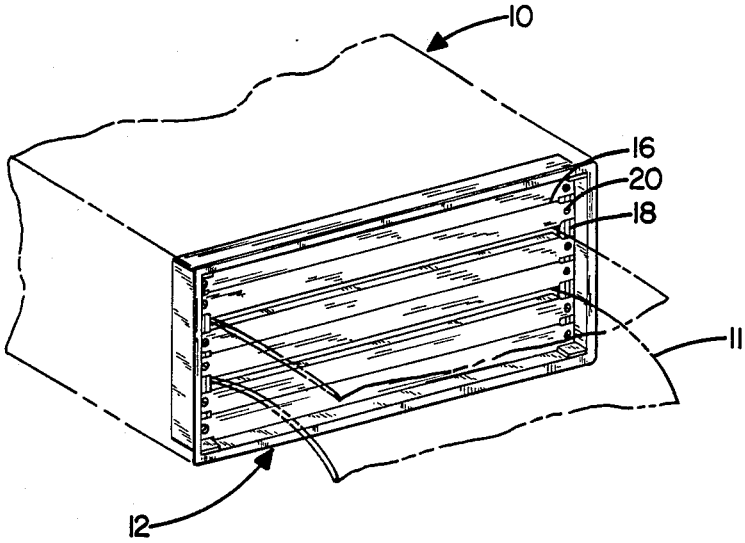
FIG. 1 is an isometric view of an acoustic silencer chamber shown in phantom outline and modular paper slot device.

In FIG. 1 a portion of an acoustic silencer box is shown in phantom outline with the adaptive paper slot device 12 forming one wall of the box. Box 10 is of a conventional acoustic sound absorbing design with sound absorbing material mounted within the box which can be made of wood, plastic, or metal. Box 10 is of a proper shape and size to fit over a printing mechanism to be silenced.

Adaptive paper slot device 12 is formed of high impact styrene plastic in this preferred embodiment because of the economics of plastic injection molding and is sized to fit within one end of box 12 to form one of the walls of the box. Four flanges extend from device 12 horizontally into the end of box 10 with the box and flanges dimensioned such that the flanges mate with the interior of the box to secure the device to the box. The flanges are secured to box 10 in any convenient manner which in the preferred embodiment is adhesive but could be by nuts or bolts or by screws. The flanges of device 12 are attached to box 10 by an adhesive such as H. B. Fuller hot melt glue or equivalent.

Figure 2:
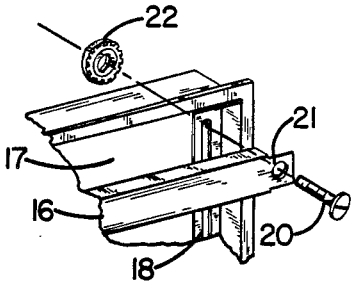
FIG. 2 is a detail of FIG. 1.
Figure 4:
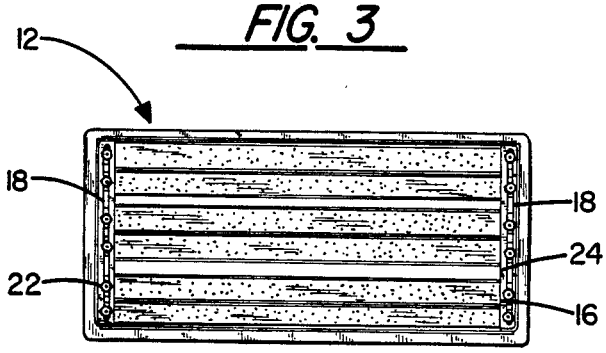
FIG. 4 is a back view of the device.

A number of horizontal bars 16 extend across device 10 which has an opening 17 extending across the entire end of box 10. As shown in FIG. 4, bars 16 extend across this open end 17 horizontally from one side to the other. Two vertical slits 18 in device 12 provide an adjusting mechanism for the bars 16 as will be described later. In FIG. 1, bars 16 have a projection from each end with a hole 21, which are attached to the device 12 by bolts 20 through slots 18 and secured by matching combined nuts and lock washers 22. FIG. 2 shows a detail of the attachment of one end of a bar 16 through slit 18 and secured by a bolt 20 through the matching hole 21 in the end of the bar and secured by the combined nut and lock washer 22.

Figure 3:
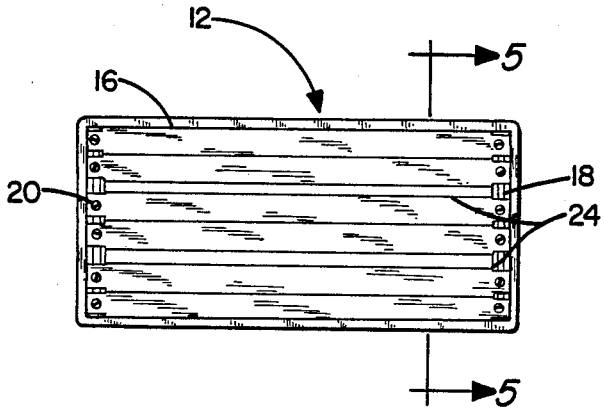
FIG. 3 is a front view of the device.

In FIG. 3, 2 horizontal slots 24 between bars 18 provide horizontal openings to feed paper to and from a printer, not shown, located within box 10. To relocate slots 24 to a different vertical location nuts 22 are loosened on bolts 20 and bar 16 moved to the new location by sliding the bolts along slits 18.

FIG. 4 shows that slits 18 extend along the full length of the sides of adapter device 12 such that bars 16 can be placed with their horizontal sides at any desired location within opening 17 at the extremes.

Figure 5:
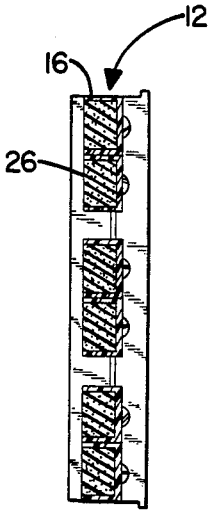
FIG. 5 is an enlarged cross-section view 5—5 of FIG. 3.

In FIG. 5 the cross-section of bars 16 can be seen. Each bar 16 has a U-shaped cross section filled with foam 26 which is $\frac{3}{4}$ inch Sonex foam polyester high density R-200 sound absorbing foam or equivalent. This foam 26 presents a sound absorbing wall of material to the sound generated within the box excepting only the slots 24 which are necessary for the proper feed.

I claim:

1. In an acoustic sound attenuating device for an impact paper printer, the combination of:

(a) a sound attenuating enclosure for an impact printer having an access opening for paper feed;

(b) an open frame sized to fit said opening in said sound attenuating enclosure, said frame being secured to said enclosure by attachment means;

(c) a set of generally parallel bars sized to fit across said open frame and close the majority of the opening in said frame excepting at least one slot between two adjacent bars, said bars being vertically slideably attached to said frame to provide adjustment, said bars formed with a generally U-shaped cross-section filled with sound absorbing material, with said bars being oriented with respect to said frame to locate said sound absorbing material on the side of the frame facing said enclosure.

2. The sound attenuating device as in claim 1 wherein said frame is generally rectangular in shape having a pair of generally parallel opposing slits across opposite ends on the periphery of said frame and wherein said bars have opposed pierced extensions on each end sized such that said bars can be attached to said frame by means of said attachment means through said pierced extensions and said pairs of slits.

* * * * *